US006038748A

United States Patent [19]

Durney et al.

[11] Patent Number: 6,038,748

[45] Date of Patent: Mar. 21, 2000

[54] LAUNDRY HOLDER WITH SOCK SNARE

[76] Inventors: Peggy R. Durney; Michael J. Durney, both of 1027 S. Tracy Ave., Bozeman, Mont. 59715

[21] Appl. No.: 09/250,517

[22] Filed: Feb. 16, 1999

Related U.S. Application Data

[63] Continuation of application No. 09/002,311, Jan. 2, 1998, abandoned

[60] Provisional application No. 60/034,218, Jan. 3, 1997.

[51] Int. Cl.[7] ..... A41F 1/00; F16G 11/00

[52] U.S. Cl. ..... 24/302; 24/3.13; 24/115 G; 24/DIG. 29

[58] Field of Search ..... 24/302, 300, 3.13, 24/115 G, DIG. 29

[56] References Cited

U.S. PATENT DOCUMENTS

| | | |
|---|---|---|
| 452,830 | 5/1891 | Bowie et al. . |
| 2,879,990 | 3/1959 | Eaton . |
| 2,953,828 | 9/1960 | Hochman . |
| 3,486,672 | 12/1969 | Esopi . |
| 4,494,264 | 1/1985 | Wattiez et al. . |
| 5,551,128 | 9/1996 | Townsend . |
| 5,611,118 | 3/1997 | Bibbee . |
| 5,697,128 | 12/1997 | Peregrine . |
| 5,711,032 | 1/1998 | Carpenter . |
| 5,809,814 | 9/1998 | Cons ..... 70/457 |

FOREIGN PATENT DOCUMENTS

| | | |
|---|---|---|
| 4030120 | 3/1992 | Germany . |
| 102730 | 12/1923 | Switzerland . |

*Primary Examiner*—Victor N. Sakran
*Attorney, Agent, or Firm*—Shook, Hardy & Bacon L.L.P.

[57] ABSTRACT

A laundry holder having a length of nylon webbing, with its ends joined with a side release buckle fastener. A sock snare, comprising a loop of nylon cording, is secured to the nylon webbing in depending relation thereto. The nylon cording is threaded through a releasable cordlock fastener. The cordlock fastener is used to adjust the size of the sock snare loop.

8 Claims, 2 Drawing Sheets

LAUNDRY HOLDER WITH SOCK SNARE

This application is a continuation of application Ser. No. 09/002,311, filed Jan. 02,1998, now abandoned.

BACKGROUND OF THE INVENTION

This invention relates to a device for keeping track of an individual's laundry, when several individuals' garments are laundered together in single loads.

There are two common devices used today to keep track of an individual's laundry when several individuals' garments are laundered together. These are: (1) a large laundry pin, and (2) a mesh laundry bag. There have been problems associated with both of these devices.

A typical laundry pin is designed much like an oversized safety pin, and is usually fashioned out of brass or other similar material, and is approximately five inches long. While the laundry pin does keep an individual's garments securely separated from the other garments during washing and drying, there are problems associated with using these laundry pins. Specifically, if a garment has no opening through which the pin can be placed, the pin's sharp pointed end must pierce the garment to secure it, thereby damaging the garment. Secondly, areas of the pin where two pieces of metal come together create places which snag garments, causing damage to the article of clothing. Thirdly, during the drying process, laundry pins can dent and even rupture dryer drums used in drying the washed garments.

With respect to the mesh laundry bag, the bag is conventionally constructed of a mesh nylon fabric, and is secured at the top by a cord and cordlock or some other method of fastening. Garments to be laundered are placed inside the mesh bag, which is then secured at the top before being placed in the washer. This laundry bag eliminates the problems encountered with using a laundry pin described above, but there are other problems associated with using a laundry bag. Specifically, garments become "wadded up" inside the bag, and this dense mass of clothing significantly increases the time required to dry garments completely. Secondly, if a laundry bag is filled to capacity, or nearly so, this mass of clothing significantly reduces the ability of a washer to clean garments adequately. Also, upon completion of the drying cycle and removal of garments from the laundry bag, garments can be severely wrinkled.

Another method of keeping track of an individual's laundry is shown in U.S. Pat. No. 5,551,128 to Townsend. This patent shows two fixed-dimension laundry loops for holding clothing in a bundle. Each laundry loop in this patent is formed by a strap, the ends of which may be buckled together. The first laundry loop is used for holding clothing having openings such as a leg or sleeve, and a second loop for holding clothing such as socks which have no openings. Since the sock holding loop cannot be adjusted in size, it is difficult to use this device when a large number of socks are to be washed. Further, when only a few pairs of socks, such as one pair, is being held by this device, the socks are held very loosely. Thus, the socks may fall out of the loop during the washing or drying process, and may be unintentionally pulled free from the loop when garmets are being removed from the washer or dryer. In using this device, the first laundry loop must be used first by threading the strap through the openings of the garments and the first strap buckled before the socks can be buckled into the second loop.

U.S. Pat. No. 2,953,822, Hockman, shows another device for laundering clothes. With this device, launderable tying members are sewn to a launderable anchoring member, preferably made of cloth or fabric material. The tying members are tied about the individual bundles of laundry pieces before laundering. This process is time consuming to use, especially when used in group laundry facilities.

In view of the foregoing, what is needed is a laundry holder which is efficient and easy to use with team or group laundry management. A device is needed which includes an adjustable size sock snare, which can be used independently of a strap loop holding garments with openings. A laundry device is also needed which has no sharp points or exposed metal components, which would damage the garments and/or dryer drums. Further, the need exists for a laundry holder which overcomes the problems associated with laundry mesh bags.

SUMMARY OF INVENTION

A laundry holder according to the present invention includes a length of nylon webbing, having its ends joined with a side release buckle fastener. A sock snare, comprising a loop of nylon cording, is secured to the nylon webbing in depending relation thereto. The nylon cording is threaded through a releasable cordlock fastener. The cordlock fastener is used to adjust the size of the sock snare loop for securely holding garments in the loop throughout the laundering process.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
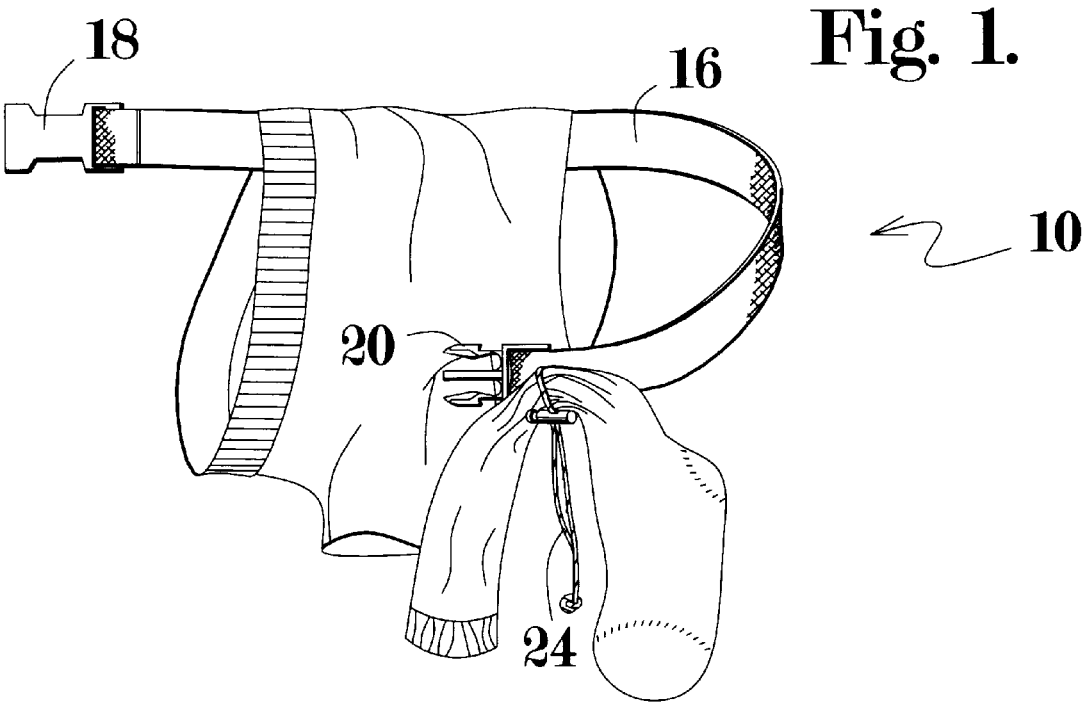
FIG. 1 is a schematic perspective view of a laundry holder being used in accordance with the present invention.
Figure 2:
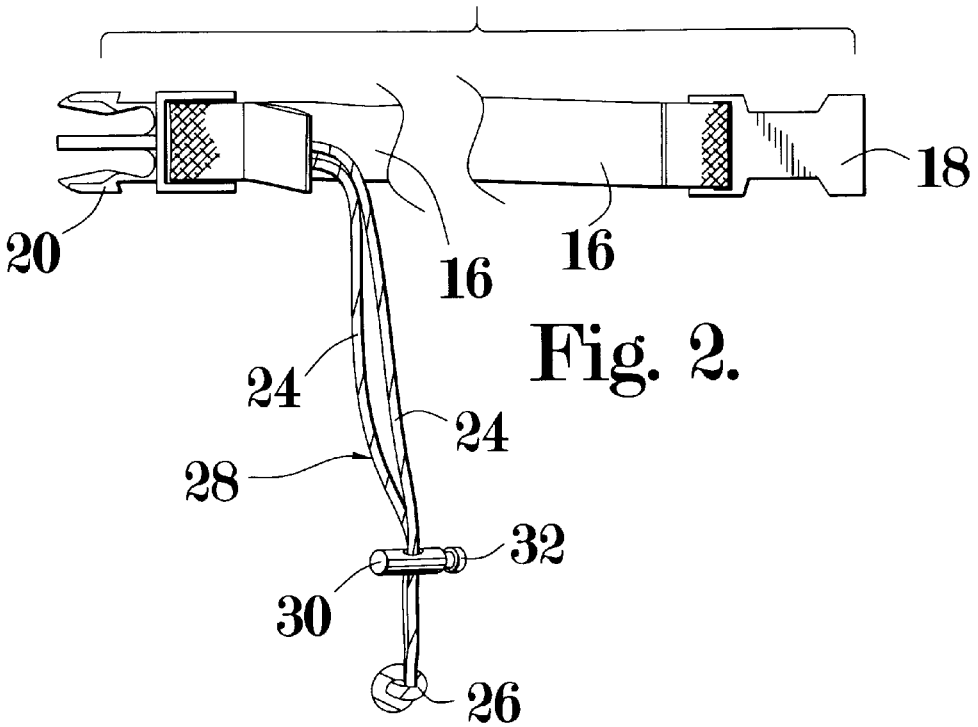
FIG. 2 is an unbuckled, plan view of the laundry holder shown in FIG. 1.
Figure 3:
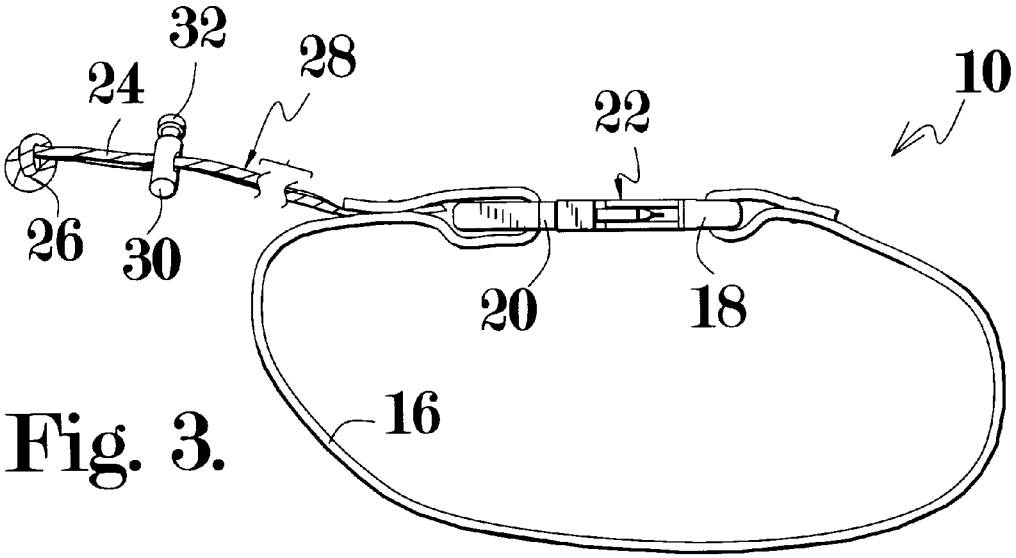
FIG. 3 is a buckled, elevational view of the laundry holder shown in FIG. 2.

A laundry holder 10 is shown in FIGS. 1–4. Laundry holder 10 includes an elongate strap having a conventional female buckle 18 secured to one end of strap 16, and a mating, conventional, male buckle 20 secured to the other end of strap 16. The buckles 18 and 20 together comprise a strap fastener 22 which in preferred embodiment is a side-squeeze buckle manufactured by National Molding Corp. Each of the buckles 18 and 20 have a strap receiving loop, 19 and 21 respectively, through which the respective ends of strap 16 are threaded. The strap 16 is then folded back onto itself and sewn together in a conventional manner to secure the buckles to the respective ends of strap 16.

Figure 4:
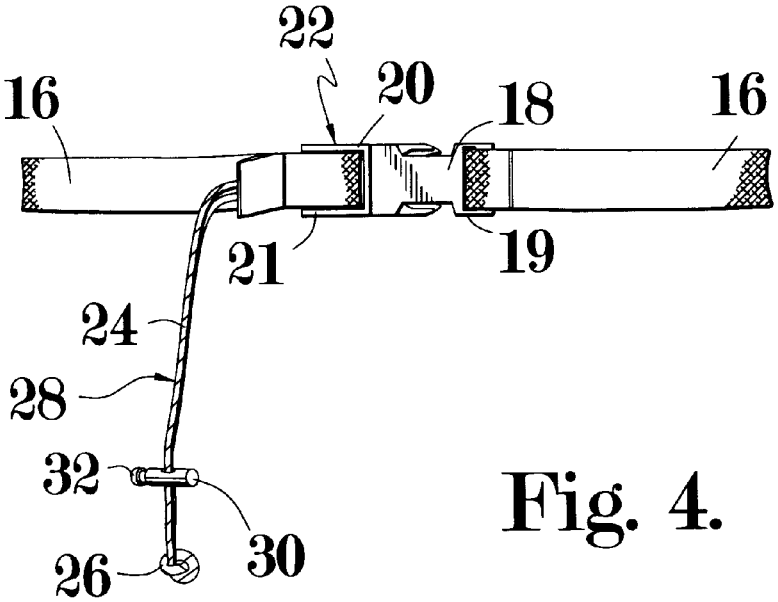
FIG. 4 is a top plan view of the laundry holder shown in FIG. 3.

A sock snare 28 is attached to the strap 16. The sock snare 28 includes a length of cording 24 which has a half-hitch knot 26 tied at the approximate mid point of the length. The two tag ends of the cording are placed side by side, thereby forming a loop of cording. The loop of cording is threaded through a releasable cordlock fastener 30, which in a preferred embodiment is a conventional nylon cordlock with a spring biased plunger 32 available from Dale Nielsen Ltd. When plunger 32 is depressed, the cordlock 30 may be slidably moved on cord 24, and when the button plunger 32 is released, the cordlock 30 is secured in its current position. The tag ends of the cording are attached as by sewing to strap 16 as shown in FIG. 4.

In operation, one end of strap 16 is led through the openings of any garments 12 having openings as shown in FIG. 1. The openings would include sleeves of shirts, necks of t-shirts, legs of pants, or waists of shorts or shirts. Male buckle 20 is joined to female buckle 18 to buckle the ends of strap 16 together. Strap 16, which has its ends joined by fastener 22, holds the garments together in one bundle.

In loading the sock snare 28, a user positions the cordlock 30 against the knot 26 tied in the cording—as far away as possible from the strap 16. The knot 26 prevents the cordlock 30 from slipping off the cording 24. By positioning the cordlock against the knot 26, the user is able to form the largest possible loop in the cording 24. In a preferred embodiment, garments lacking an opening, which garments would include socks and towels, are threaded through the loop formed by the cording 24, with approximately half of each garment extending on either side of such cording. Button 32 of cordlock 30 is then depressed and the cordlock 30 is moved toward the strap 16 snugly against the garments held within the loop formed in cording 24.

When the loading process of the laundry holder 10 has been completed, the bundle of garments may be washed or dried with the bundle being held together as one unit, separate from other bundles or garments being laundered at the same time.

The above description is by way of example only. It is contemplated that garments having openings could also be loaded in the sock snare 28, and further that rather than placing garments between the lock 28 and strap 16, that the process could be reversed and garments placed between the cordlock 28 and knot 26 with the cordlock 28 being positioned snugly against the garments being held in the loop between cordlock 28 and knot 26.

With this laundry holder 10, it is also contemplated that the garments held by cord 24 could be loaded first, prior to loading the garments in the loop formed by strap 16. It makes no difference which loop is loaded first. The present invention is highly adaptable to cover many different situations.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

I claim:

1. A device for holding laundry comprising:

a strap having opposite ends;

a fastener for releasably connecting the opposite ends of the strap together;

a pair of cords coupled to the strap, and a releasable cordlock through which the pair of cords is threaded, the releasable cordlock selectively positionable on the cords to form a loop of variable size between the cordlock and the strap, whereby laundry corresponding to said variable size is frictionally secured within the loop.

2. The device according to claim 1, wherein the fastener includes:

a male buckle connected to one end of the strap; and a mating, female buckle connected to the other end of the strap.

3. The device according to claim 1, wherein the fastener includes a squeezable side release fastener.

4. The device according to claim 1, wherein the releasable cordlock includes a spring biased plunger which releases the cords when the plunger is depressed, and which grips the cords when the plunger is released.

5. The device according to claim 1, wherein the pair of cords are joined at an end of the cords distal from the strap.

6. The device according to claim 5, wherein the pair of cords are integrally formed with one another at an end of the cords.

7. The device according to claim 5, further comprising a stop positioned on the cords between the releasable plunger and the end of the cords joined to one another, wherein the stop prevents the releasable cordlock from sliding off the cords.

8. The device according to claim 7, wherein the stop includes a knot formed on the cords.

* * * * *